US006112540A

United States Patent [19]

Serrels et al.

[11] Patent Number: 6,112,540

[45] Date of Patent: Sep. 5, 2000

[54] ICE MAKER

[75] Inventors: Richard Serrels, Flint; Gerald E. Hill, Fenton, both of Mich.

[73] Assignee: Varity Automotive, Inc., Buffalo, N.Y.

[21] Appl. No.: 09/057,007

[22] Filed: Apr. 7, 1998

[51] Int. Cl.[7] ..... F25C 1/12

[52] U.S. Cl. ..... 62/351; 62/353

[58] Field of Search ..... 62/71, 73, 351, 62/353

[56] References Cited

U.S. PATENT DOCUMENTS

| | | | |
|---|---|---|---|
| 2,770,102 | 11/1956 | Roedter | 62/353 |
| 2,941,377 | 6/1960 | Nelson | 62/353 |
| 2,949,749 | 8/1960 | Reddi | 62/353 |
| 3,206,940 | 9/1965 | Archer | 62/353 |
| 3,393,531 | 7/1968 | Parr | 62/356 |
| 3,407,840 | 10/1968 | Finnegan | 137/392 |
| 3,678,701 | 7/1972 | Powell et al. | 62/353 |
| 3,959,981 | 6/1976 | Anderson | 62/356 |
| 4,649,718 | 3/1987 | Linstromberg et al. | 62/347 |
| 4,697,432 | 10/1987 | Cole | 62/353 |
| 4,706,465 | 11/1987 | Searl | 62/353 |
| 5,212,955 | 5/1993 | Hogan | 62/353 |
| 5,329,786 | 7/1994 | Willis et al. | 62/353 |

*Primary Examiner*—William E. Tapolcai
*Attorney, Agent, or Firm*—Wells, St. John, Roberts, Gregory & Matkin, P.S.

[57] ABSTRACT

An ice maker has an ice tray having at least one fluid receptor cavity for forming an ice mass therein. An ejector assembly conveniently has one or more ejector members corresponding in number and in register respectively with the cavities. The ejector assembly is fixed with respect to the tray and the tray is movable relative to said assembly to cause entry of the or each member into its associated cavity and consequent ejection of the formed ice mass therefrom.

23 Claims, 2 Drawing Sheets

ICE MAKER

BACKGROUND OF THE INVENTION

This invention relates to an ice maker primarily for use in a refrigerator or freezer, and having an ice tray with at least one fluid receptor cavity in the or each of which an ice mass is formed, in use, and an ejector device operable to eject formed ice masses from the tray.

DESCRIPTION OF THE PRIOR ART

In a first known proposal, an ejector device has a respective ejector member for each cavity of the tray, the members being coupled for rotation relative to the tray and arranged so that upon rotation, free end portions thereof are brought into the associated tray cavities to cause ejection laterally of the tray of ice masses contained in the cavities. It is usually necessary to heat the tray to release the frozen masses for ejection.

The lateral ejection of the ice masses is disadvantageous in requiring considerable space within a freezer compartment and heating of the tray leads to high electricity consumption.

Another known proposal involves rotating the tray so that its end remote from a driven end thereof engages a stop, whereby continued rotary driving of the tray causes twisting of the latter to free the ice masses for ejection. This proposal can lead to incomplete ice mass ejection and the continual stressing of the ice tray can give rise to damage and possible failure thereof. High electricity consumption can again also be a problem.

SUMMARY OF THE INVENTION

A primary object of the present invention is to provide an ice maker, primarily for a refrigerator or freezer, which is more space and energy efficient than said first known proposal.

Another object of the invention is to provide an ice maker having an improved means of ice mass ejection when compared with either of said known proposals.

According to one aspect of the invention, an ice maker comprises an ice tray having a fluid receptor cavity for forming an ice mass therein, and an ejector member in register with the cavity and fixedly mounted with respect to the tray, the tray being movable relative to the ejector member to cause entry of the member into the cavity and consequent ejection of the formed ice mass from the cavity.

Preferably, the relative dispositions of the tray and ejector member are such that, in use, the ice mass is ejectable from its cavity with the tray moved to a position in which the ejected ice mass falls from a location generally below the ejector member.

This may conveniently be achieved by an arrangement in which, with the tray in an initial position, the cavity provides a support surface for a formed ice mass, and with the tray positioned for ejection of the ice mass the support surface no longer provides such support, enabling the ice mass to fall from a location generally below the ejector member.

The or each cavity is conveniently provided with a low friction ice mass support surface and the movement of the tray relative to the or each ejector member is preferably rotary.

The ability of the ice maker of the invention to eject the ice masses downwardly to a location in which a suitable receptacle may conveniently be located makes better use of available space than the first known proposal. Moreover, the positive displacement of the masses from the moving cavity provides reliable ejection, and coupled with the low friction surfaces of the cavities leads to energy gains.

From another aspect of the invention, an ice maker comprises an ice tray having a plurality of cavities for forming respective ice masses therein successively arranged along the tray, and a plurality of ejector members respectively in register with said cavities, the cavities and ejector members being arranged so that relative movement between the tray and the ejector members causes the ejector members to enter said respective cavities one after another to sequentially eject the ice masses from said cavities the ejector members having mutually differing lengths.

From another aspect of the invention, an ice maker comprises an ice tray having a plurality of cavities for forming respective ice masses therein successively arranged along the tray, and a plurality of ejector members respectively in register with said cavities, the cavities and ejector members being arranged so that relative movement between the tray and the ejector members causes groups of said ejector members to enter respective groups of said cavities to eject corresponding groups of ice masses from said cavities.

When ejection of single ice masses in succession is required, the ejector members have mutually differing lengths or are staggered about an axis extending in a direction along the tray. The ice masses may alternatively be ejected in groups by arranging the members so that groups thereof enter respective groups of cavities to eject corresponding groups of masses.

These arrangements of ejector members to avoid simultaneous ejection of all the ice masses make possible the use of smaller lower torque motors, giving advantages of less required space and reduced energy consumption.

Other and further objects of the present invention will become evident from an understanding of the following illustrative embodiment, or will be indicated in the appended claims.

DESCRIPTION OF THE PREFERRED EMBODIMENT

An embodiment of the present invention will now be described, with reference to the accompanying drawings.

Figure 1:
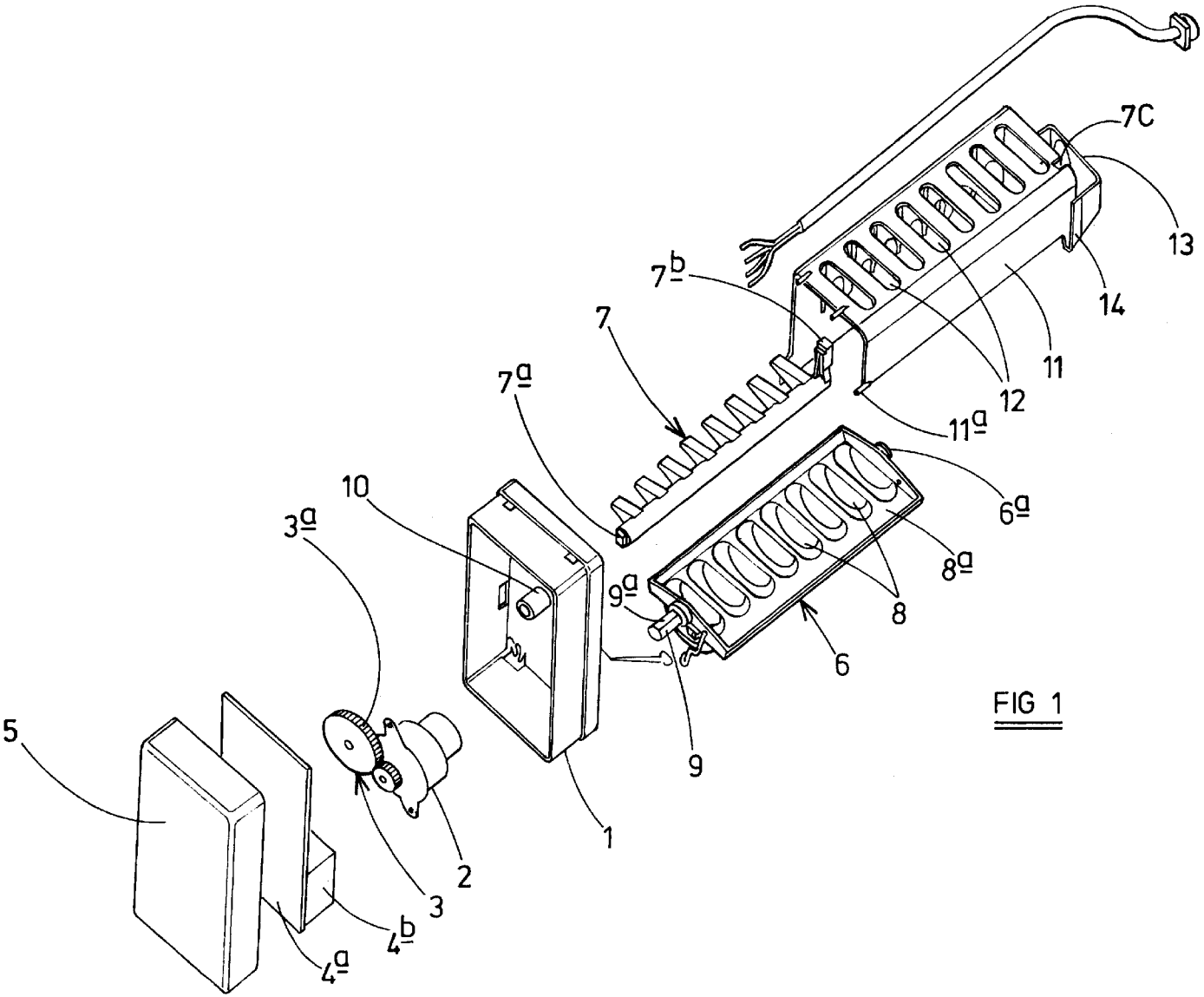
FIG. 1 is an exploded perspective view of one form of the ice maker of the invention.

Referring first to FIG. 1, an ice maker has a hollow casing 1 which houses a driving motor 2 from which an output drive is taken through a gear mechanism 3. An electronic unit, which includes a circuit board 4*a* and a transformer 4*b* is housed within the casing 1 and the casing is closed by a covering lid 5.

The casing 1 serves as a main support structure of the ice maker and carries an ice tray 6 and an ice mass ejector assembly 7 which lies above and extends longitudinally of the tray. The tray has a plurality of fluid receptor cavities or compartments 8, of which eight are provided in the illustrated embodiment. The tray is provided with a drive shaft 9 of non-circular cross section, illustrated with a flat 9*a*, the shaft extending through an internal boss 10 of the casing 1 and into driving engagement with the output gear 3*a* of the gear mechanism 3. By this means, the tray can be driven in rotation through a limited arc, as will be described hereafter. The ejector assembly 7 is secured to the casing in non-rotatable manner and, as illustrated, has a square end boss 7*a* which is received in a corresponding recess (not shown) of the casing 1.

A cover 11 is provided, having a generally inverted channel shape, and is attached to the casing 1 by suitable means illustrated as snap-engaging tags 11*a* on the cover which cooperate with complementary recesses (not shown) on the casing. The cover extends entirely over the cavities 8 and is provided in its upper wall with a series of apertures, shown as slots 12, which respectively correspond with and overlie the cavities 8. The end wall of the cover remote from the housing provides rotational support for the adjacent end of the tray 8 in the form, for example, of a hollow boss which houses a corresponding solid boss 6*a* of the tray. The cover also has a cut-out 7C for engagement by a support device 7*b* on the adjacent end of the ejector assembly remote from the casing.

The end of the cover remote from the casing 1 carries a formation, which may conveniently be moulded integrally with the cover, forming a fluid collector 13 extending over a major part of the end of the cover and terminating in an outlet spout 14 which extends along the adjacent side of the cover in a direction towards the casing 1. The aforesaid adjacent side of the cover lies inwardly of the adjacent free edge of the tray 6 so that the spout may direct fluid onto a surface 8*a* of the tray, which bridges across all of the cavities 8 and acts as a fluid distributor serving to direct water into all of the cavities.

Figure 2:
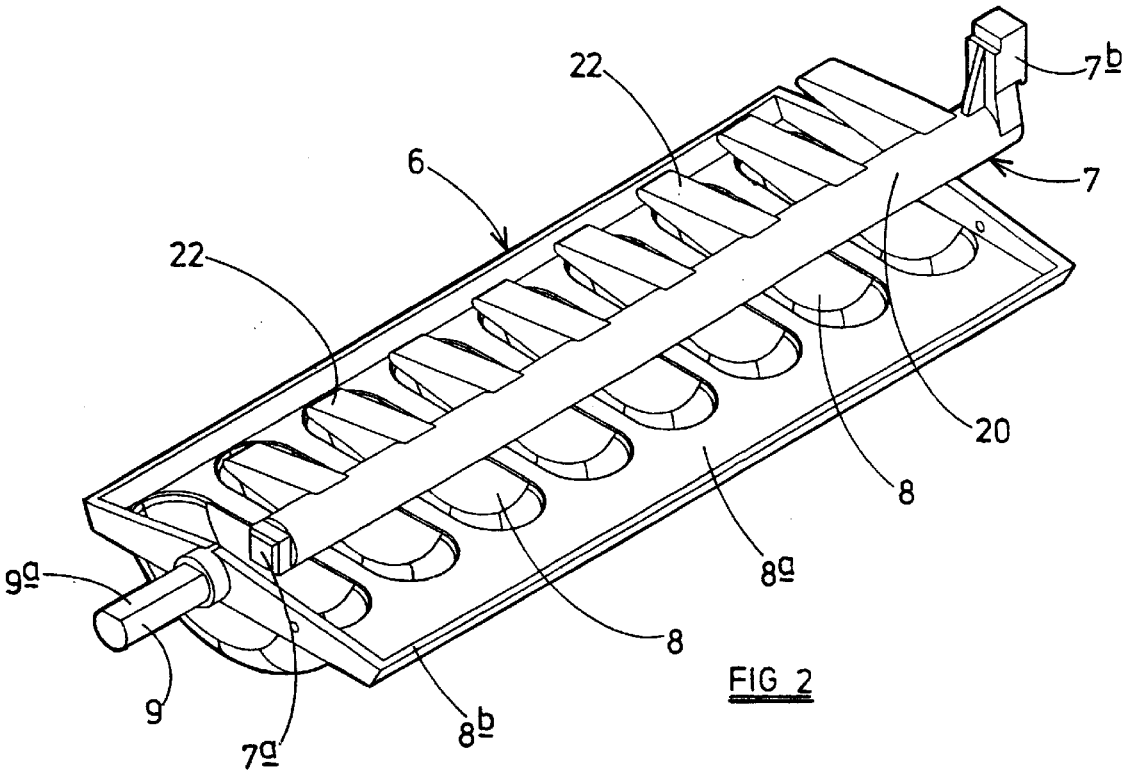
FIG. 2 is an enlarged perspective view illustrating a tray forming part of the ice maker of FIG. 1.
Figure 3:
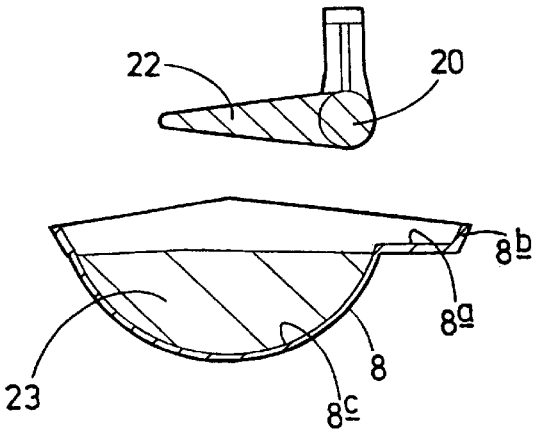
FIG. 3 is a part-sectional side view illustrating components of the ice maker in a first operative condition.
Figure 4:
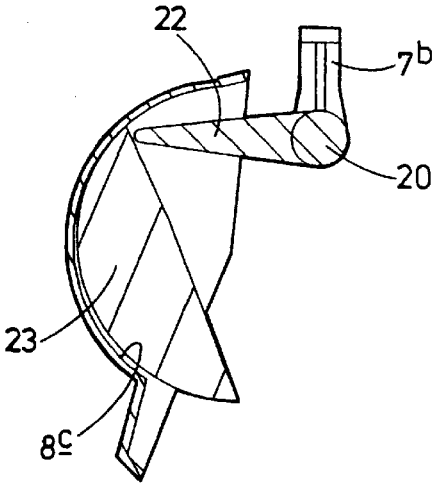
FIG. 4 is a view similar to FIG. 3 illustrating the components in a second operative condition.

The tray 6 and ejector assembly 7 are shown in more detail in FIGS. 2 to 4. It will be seen that the tray cavities are of generally hemispherical longitudinal cross section and extend widthwise of the tray from closely adjacent one longitudinal side of the tray to a location adjacent the inner edge of the distributor surface 8*a*, the outer edge of which is delimited by an upstanding angled wall in the form of a flange 8*b*.

The ejector assembly 7 has a stem 20 which extends above and longitudinally of the tray, the stem being positioned generally adjacent and in line with the innermost edge of the surface 8*a*. The stem is mounted non-rotatably in the casing by way of the generally square end formation 7*a* and on the internal end surface of the cover by way of the support formation 7*b*. The stem carries a plurality of ejector members, shown as fingers 22, conveniently formed integrally therewith by moulding, and corresponding in number to the cavities 8, which they respectively overlie. In this embodiment, the lengths of the fingers 22 increase progressively from the casing end of the assembly towards its other end. FIG. 3 illustrates more clearly the positioning of the shorter of the fingers 22 at the casing end of the assembly and it can be seen that the free end of the finger is disposed offset from the centre of the underlying cavity 8. The lengths of the remaining fingers increase progressively towards the respective left hand ends of their associated cavities.

FIGS. 3 and 4 illustrate the tray containing ice masses 23 formed following a previous tray-filling and freezing operation. In order to eject the formed ice masses from the tray, the tray is rotated, by operation of the motor 2, through an angle which is typically greater than 90° from its illustrated starting point in FIG. 3, up to a maximum of about 105°. FIG. 4 illustrates the maximum ice ejector angle and it will be seen that, in the illustrated rotated position of the tray, the then upper region of the ice mass 23 has contacted the fixed finger 22 and been dislodged from its initial position within the tray. It will be seen that, in the tray position illustrated in FIG. 4, the internal ice support surface 8*c* of the cavity has moved to a position in which it no longer provides support for the ice mass 23 at a location below the finger 22, so that, after dislodgement by the finger 22, the ice mass is able to fall under gravity out of the cavity for collection at a location beneath the tray. This action is aided by coating the surface 8*c* with a low friction material having a high grade surface finish.

The facility for ice mass ejection below the fingers in the manner illustrated is very convenient in that it minimises the room required within a freezer compartment to accommodate the ice making tray. Moreover, considerable energy saving is achieved by ejecting the ice masses in succession, rather than simultaneously, by the use of progressively differing finger lengths, as described. A similar effect may be achieved by additionally, or alternately, staggering the fingers about the axis of the stem and it would also be possible to arrange for the fingers to eject the ice masses in groups, rather than singly, by appropriately varying the finger lengths, and/or staggering the finger positions.

We claim:

1. An ice maker comprising an ice tray having a fluid receptor cavity for forming an ice mass therein, and an ejector member in register with the cavity and fixedly mounted with respect to the tray, the tray being movable relative to the ejector member to cause entry of the member into the cavity and consequent ejection of the formed ice mass from the cavity.

2. An ice maker as claimed in claim 1, wherein the relative dispositions of the tray and the ejector member are such that, in use, the ice mass is ejectable from its cavity with the tray moved to a position in which the ejected ice mass falls from a location generally below the ejector member.

3. An ice maker as claimed in claim 1, wherein with the tray in an initial position, the cavity provides a support surface for a formed ice mass, and with the tray positioned for ejection of the ice mass the support surface no longer provides such support, enabling the ejected ice mass to fall from a location generally below the ejector member.

4. An ice maker as claimed in claim 1, wherein the cavity comprises a low friction ice mass support surface.

5. An ice maker as claimed in claim 1, wherein said tray is rotatably movable relative to the ejector member.

6. An ice maker as claimed in claim 1, wherein the tray has a plurality of said cavities successively arranged along the tray, and a plurality of said ejector members arranged to cause ejection of said ice masses one by one.

7. An ice maker as claimed in claim 6, wherein the ejector members have mutually differing lengths.

8. An ice maker as claimed in claim 6, wherein respective operative end portions of the ejector members are mutually angularly staggered about an axis extending in a direction along the tray.

9. An ice maker as claimed in claim 1, wherein the tray has a plurality of said cavities successively arranged along the tray, and a plurality of said ejector members arranged to cause ejection of said ice masses in a plurality of groups.

10. An ice maker as claimed in claim 9, wherein at least some of the ejector members have mutually differing lengths.

11. An ice maker as claimed in claim 9, wherein respective operative end portions of at least some of the ejector members are mutually angularly staggered about an axis extending in a direction along the tray.

12. An ice maker comprising an ice tray having a plurality of cavities for forming respective ice masses therein successively arranged along the tray, and a plurality of ejector members respectively in register with said cavities, the cavities and ejector members being arranged so that relative movement between the tray and the ejector members causes the ejector members to enter said respective cavities one after another to sequentially eject ice masses from said cavities, the ejector members having mutually differing lengths.

13. An ice maker as claimed in claim 12, wherein respective operative end portions of the ejector members are mutually angularly staggered about an axis extending in a direction along the tray.

14. An ice maker as claimed in claim 12, wherein the ejector members are fixed and the tray is rotatably mounted relative to said members.

15. An ice maker as claimed in claim 12, wherein the relative dispositions of the tray and the ejector members are such that, in use, the formed ice masses are ejectable respectively from said cavities with the tray moved to a position in which the ejected ice masses fall from a location generally below the ejector members.

16. An ice maker as claimed in claim 12, wherein with the tray in an initial position, each cavity provides a support surface for a respective formed ice mass, and with the tray positioned for ejection of the ice masses the support surfaces no longer provide such support, enabling the ice masses to fall from a location generally below the ejector members.

17. An ice maker comprising an ice tray having a plurality of cavities for forming respective ice masses therein successively arranged along the tray, and grouped pluralities of ejector members respectively in register with grouped pluralities of respective said cavities, the cavities and ejector members being arranged so that relative movement between the tray and the ejector members causes the ejector members of each said grouped plurality of ejector members to simultaneously enter respective said cavities of a corresponding respective grouped plurality of said cavities for sequentially ejecting corresponding grouped pluralities of ice masses from said cavities.

18. An ice maker as claimed in claim 17, wherein at least some of the ejector members have mutually differing lengths.

19. An ice maker as claimed in claim 17, wherein respective operative end portions of at least some of the ejector members are mutually angularly staggered about an axis extending in a direction along the tray.

20. An ice maker as claimed in claim 17, wherein the ejector members are fixed and the tray is rotatably mounted relative to said members.

21. An ice maker as claimed in claim 17, wherein the relative dispositions of the tray and the ejector members are such that, in use, the formed ice masses are ejectable respectively from said cavities with the tray moved to a position in which the ejected ice masses fall from a location generally below the ejector members.

22. An ice maker as claimed in claim 17, wherein with the tray in an initial position, each cavity provides a support surface for a respective formed ice mass, and with the tray positioned for ejection of the ice masses the support surfaces no longer provide such support, enabling the ice masses to fall from a location generally below the ejector members.

23. An ice maker comprising an ice tray having a plurality of cavities for forming respective ice masses therein successively arranged along the tray, and a plurality of ejector members respectively in register with said cavities, the cavities and ejector members being arranged so that relative movement between the tray and the ejector members causes at least some of the ejector members to enter said respective cavities one after another to sequentially eject ice masses from said cavities, at least some of the ejector members having mutually differing lengths.

* * * * *